US005743533A

United States Patent [19]

Wiles et al.

[11] Patent Number: 5,743,533

[45] Date of Patent: Apr. 28, 1998

[54] BACK UP TURN FUNCTION FOR DART MACHINE

[75] Inventors: Robert H. Wiles, Yarmouth, Me.; John C. Nydick, Havertown, Pa.

[73] Assignee: Merit Industries, Inc., Bensalem, Pa.

[21] Appl. No.: 691,971

[22] Filed: Aug. 2, 1996

[51] Int. Cl.[6] ..... F41J 5/00

[52] U.S. Cl. ..... 273/371

[58] Field of Search ..... 273/371

[56] References Cited

U.S. PATENT DOCUMENTS

| | | | |
|---|---|---|---|
| 4,057,251 | 11/1977 | Jones et al. | 273/95 R |
| 4,516,781 | 5/1985 | DeVale et al. | 273/373 |
| 4,793,618 | 12/1988 | Tillery et al. | 273/376 |
| 4,881,744 | 11/1989 | Hansen | 273/376 |
| 4,974,857 | 12/1990 | Beall et al. | 273/371 |
| 5,020,806 | 6/1991 | Martin | 273/371 |
| 5,116,063 | 5/1992 | Harlan et al. | 273/376 |
| 5,156,643 | 10/1992 | Grubek | 273/376 |
| 5,401,033 | 3/1995 | Lychock, Jr. | 273/371 |
| 5,553,861 | 9/1996 | Pan | 273/371 |

*Primary Examiner*—William H. Grieb

*Attorney, Agent, or Firm*—Panitch Schwarze Jacobs & Nadel, P.C.

[57] ABSTRACT

A dart game machine that electronically scores dart throws includes a reset mode which allows the game score to be backed up to a previous score state. The dart game machine includes a score data memory which tracks current and previous score data for each player so that the previous scores may be automatically restored upon backing up of the game.

16 Claims, 4 Drawing Sheets

BACK UP TURN FUNCTION FOR DART MACHINE

FIELD OF THE INVENTION

The present invention relates generally to dart games and, more particularly to a scoring feature of a dart game.

BACKGROUND OF THE INVENTION

Electronic dart game machines which electronically store and display game score data are well-known in the art. As each dart is thrown, the dart game automatically updates the current player's score. For example, U.S. Pat. No. 5,156,643 (Grubek) shows a display monitor which provides the current total score for each of two players. Electronic dart game score displays which provide the current total score for each of a plurality of players are also shown in U.S. Pat. No. 4,793,618 (Tillery et al.), U.S. Pat. No. 5,020,806 (Martin), and U.S. Pat. No. 5,401,033 (Lychock, Jr.).

In the course of a dart game, an error, such as a machine malfunction or player error may lead to a scoring dispute. The player error may be the result of the player shooting out of order, fouling, or being distracted by a sudden event in the game surroundings. The scoring dispute may have serious consequences if it occurs during league or tournament play. Presently, when a scoring dispute occurs, the entire game is canceled and the machine must be restarted and manually set to the position it was in just prior to where the dispute occurred. The restarting and manual setting procedure is lengthy, difficult and prone to mistakes. The restarting and manual setting procedure also presents particular problems when the game being played is "Cricket," because the scoring rules of Cricket are complex. The restarting and manual setting procedure may also be abused. Players may repeatedly restart and manually set the machine, thereby slowing game progress. Restarting and manually setting a game may also upset a player's expectations about a game. For example, if a game is nearing its end, or a player has won, restarting and manually setting the game to a much earlier point in time or to just before a player has won may be unfair to the player who is currently ahead or believes he has fairly won a game.

Accordingly, there is a need for a system which allows dart games to be quickly and easily backed up to a previous state without requiring the game to be restarted and manually set, but which does not allow the back up feature to be abused or to upset player expectations. The present invention fills these needs.

SUMMARY OF THE INVENTION

The present invention is for use in a dart game machine having electronically stored game score data which is automatically updated based upon each player's turn throwing one or more darts. Specifically, the present invention is directed to a method of returning the score data in such a dart game machine to a previous state. The method comprises activating a reset mode for backing up the game score to the beginning of a previous turn and replacing current game score data with game score data in effect before the turn in which the game is backed up to.

Another embodiment of the invention is directed to an apparatus for returning a dart game to a previous state. The apparatus includes a memory for electronically storing current game score data and game score data for one or more previous player turns. The apparatus also includes a reset mode. When the reset mode is activated, the game score may be backed up to the beginning of a previous turn. Then, the current game score data is replaced with game score data that existed before the turn in which the game is backed up to. Games may be backed up in response to human errors in game play, electronic errors from machine malfunctions, or predesignated events.

BRIEF DESCRIPTION OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF PREFERRED EMBODIMENT

Figure 1:
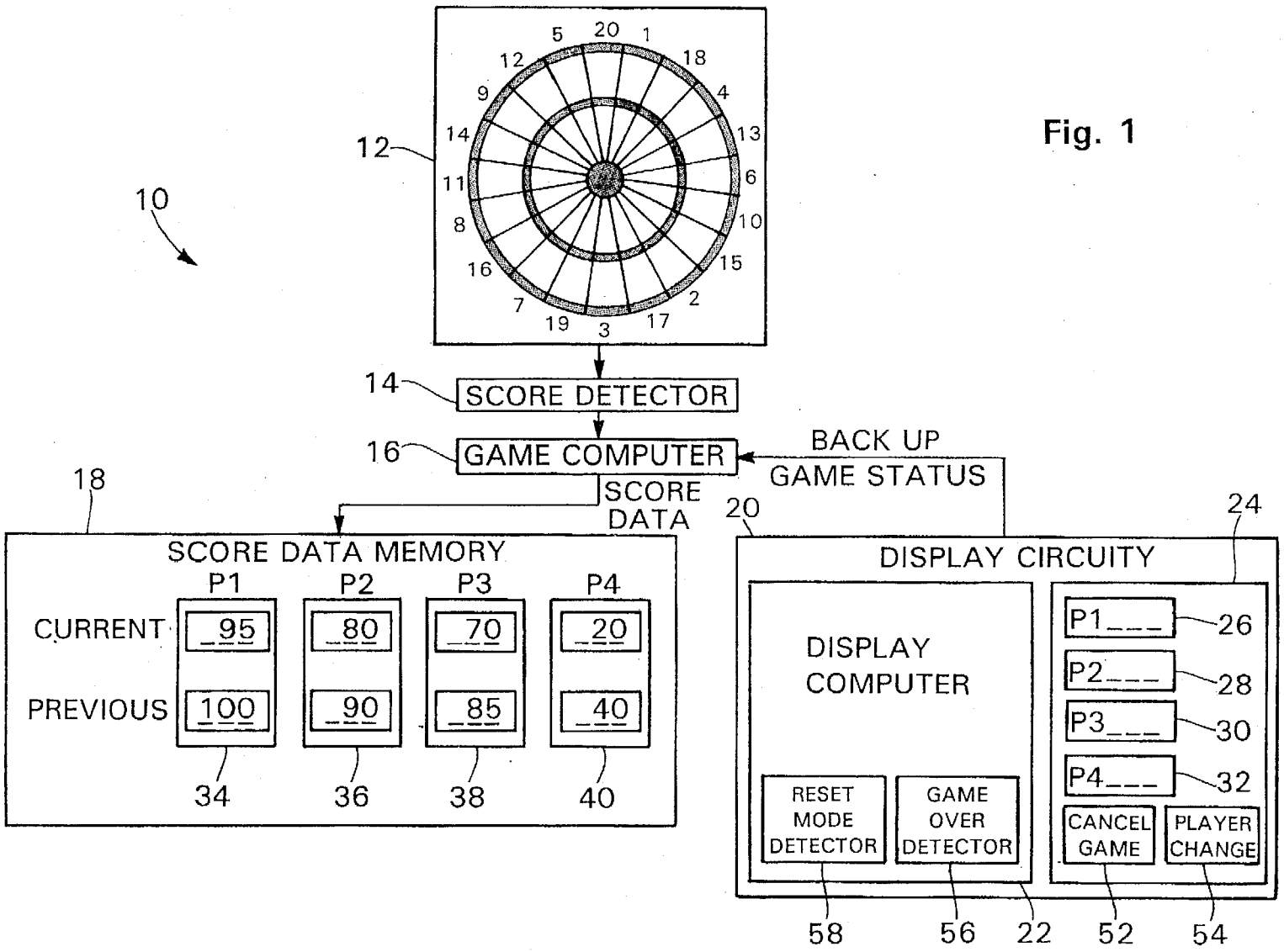
FIG. 1 is a schematic block diagram of score data memory circuitry and display circuitry of an electronic dart game machine in accordance with a preferred embodiment of the present invention in the environment of a dart game.

Certain terminology is used herein for convenience only and is not be taken as a limitation on the present invention. In the drawings, the same reference numerals are employed for designating the same elements throughout the several figures.

FIG. 1 shows an electronic dart game 10 including an electronic dart board 12, a score detector 14 connected at its input to the output of the electronic dart game 12, a game computer 16 connected at its input to the output of the score detector 14, and score data memory 18 connected at its input to the output of the game computer 16. The score data memory 18 is connected at its output to display circuitry 20. The electronic dart board 12, score detector 14, and game computer 16 are well-known in the prior art. The score detector 14 may be any suitable means for identifying target areas of a dart board 12 which have been hit by a dart. The score detector 14 also identifies which segment of the dart board 12 has been hit so that the appropriate score may be tallied for a hit. Dart games which disclose electronic dart boards 12, score detectors 14 and game computers 16 are shown and described in U.S. Pat. No. 4,057,251 (Jones et al.); U.S. Pat. No. 4,516,781 (DeVale et al.); U.S. Pat. No. 4,793,618 (Tillery et al.); U.S. Pat. No. 4,881,744 (Hansen); U.S. Pat. No. 4,974,857 (Beall et al.); U.S. Pat. No. 5,116,063 (Harlan et al.); and U.S. Pat. No. 5,401,033 (Lychock, Jr.), the subject matter of which are incorporated herein by reference.

The score data memory 18 and the display circuitry 20 incorporate the novel features of the present invention. The display circuitry 20 includes a display computer 22 which operates in accordance with a program such as illustrated by the flow diagram shown in FIGS. 3A and 3B. In the normal mode of operation, the display computer 20 receives current score data from the score data memory 18 and updates the current score display accordingly. When it is desired to back up the game as discussed in greater detail below, the display computer retrieves appropriate previous score data from the score data memory 18.

FIG. 1 depicts an example of a dart game 10 suitable for use when up to four players play a game or match, although a greater or lesser number of players may be involved. For example, another preferred embodiment of the invention allows eight players to play a game or match. The display circuitry 20 has a front panel 24 with four display areas 26, 28, 30 and 32, corresponding to players 1–4. The score data memory 18, likewise, has four memory locations 34, 36, 38 and 40, corresponding to the same players 1–4. Each memory location includes a current score and an immediately previous score for the respective player. The current score is the player's score after completion of the player's latest or last turn (if the player is not currently shooting, that is, if it is not the player's turn) or the player's score after the last dart throw (if the player is currently shooting, that is, if it is the player's turn). The previous score is the player's score after completion of the player's turn before the last turn (if the player is not currently shooting) or the player's score after the last completed turn (if the player is currently shooting).

FIG. 1 shows sample display values at one point during a game of 301 wherein scores begin at 301 and progress to a goal score of zero. Player 2 is the current player and is in the middle of his turn. Player 2 had a score of 90 before he started his turn. Accordingly, the previous score for Player 2 is 90 since that was the score at the end of his last completed turn. The score of 90 is stored in the previous score memory location 36 of Player 2. In the current turn, Player 2 has thrown one dart for 10 points and has more darts to throw before his turn is completed. Accordingly, Player 2 has a current score of 80 which is stored in the current score memory location 36 of Player 2 and shown in display area 28. Players 1, 3 and 4 have current scores of 95, 70 and 20, respectively, which are stored in respective current score memory locations 34, 38 and 40 and shown in respective display areas 26, 30 and 32. Players 1, 3 and 4 have previous scores of 100, 85 and 40, respectively, which are stored in respective previous score memory locations 34, 38 and 40.

Whenever a player commences a new turn, the previous score is replaced by the current score before the first dart of the turn is thrown. The current score is then decremented in response to new dart throws. (In dart games which begin at zero and progress to a goal score, the score would be incremented.) Thus, at all times, the score data memory 18 has a record of each player's current score and immediately previous score. The previous score data is used to back up the game score in a manner hereinafter described to return the score data to the previous state upon the happening of an error in the game.

Figure 2:
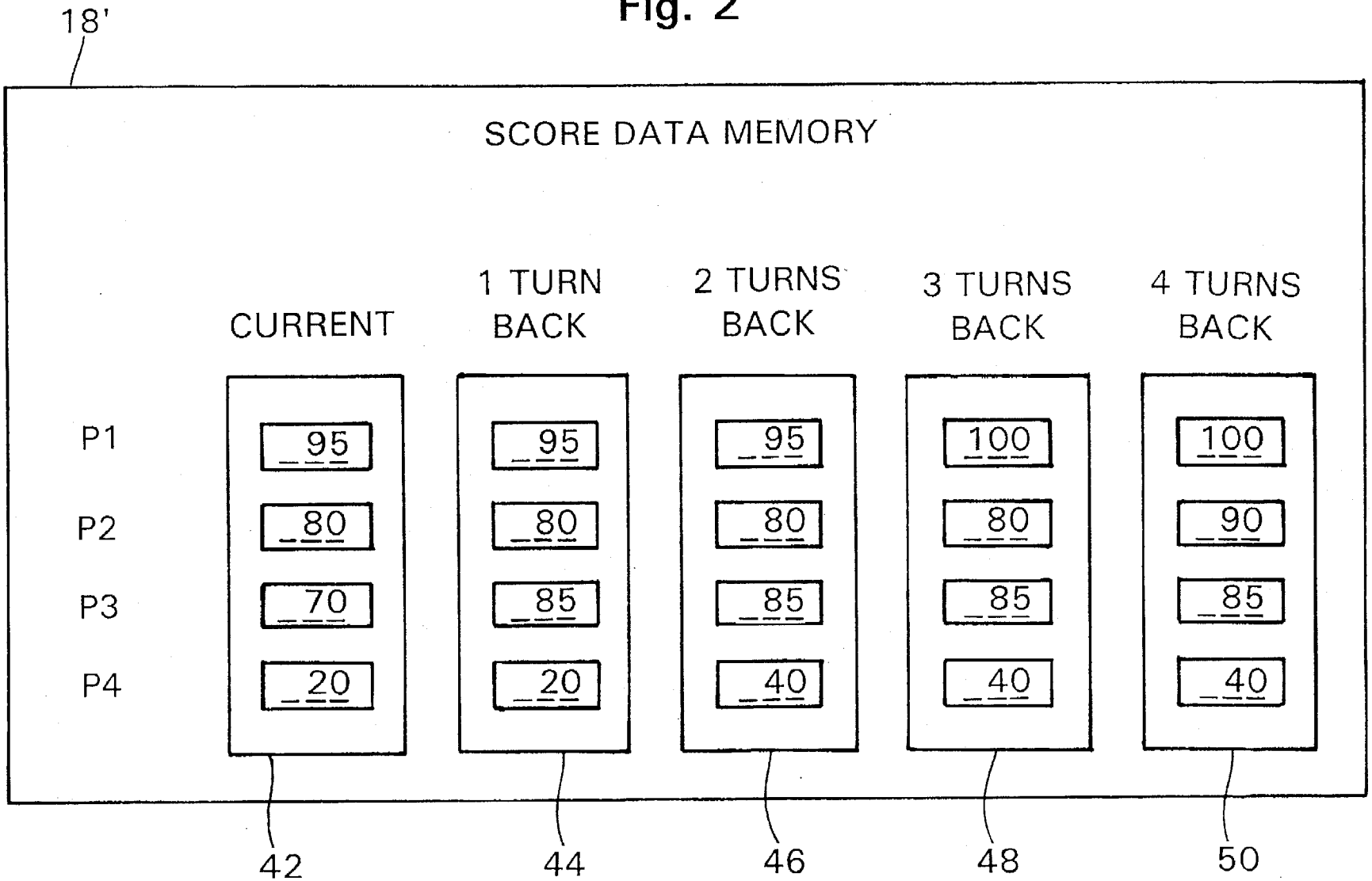
FIG. 2 is a schematic block diagram of alternative score data memory circuitry for use in the machine of FIG. 1, in accordance with another preferred embodiment of the present invention.

FIG. 2 shows an alternative embodiment of the score data memory 18'. The embodiment of FIG. 2 organizes the score data according to turns, not players. Thus, there is a memory location 42 for the current turn which includes the current score for each player, and a memory location for the score of previous turns. The embodiment of FIG. 2 provides a number of previous turn memory locations equal to the total number of players. Accordingly, there are four previous turn memory locations 44, 46, 48 and 50. If there were only two players in the game, there would only be two previous turn memory locations. After each player completes his turn and before the next player commences his turn, each set of scores for that player is shifted to the right. Thus, the current score data becomes the score data for one turn back, the one turn back score data becomes the score data for two turns back, and so on. The score data for four turns back is erased when it is replaced by the score data for three turns back. When it is desired to back up the score status of the game, the display computer 22 merely retrieves the set of score data for the appropriate turn. A comparison of score data memory 18 and 18' shows that the values in the score data memory 18' are easily derived from the score data in memory 18, and vice-versa. The score data memory 18' requires more memory locations than the score data memory 18. However, when using the score data memory 18, the display computer 22 must perform data manipulations to obtain the score status for a given turn. In contrast, the score status for a given turn is immediately available from the score data memory 18'. Whether the score data memory 18 or 18' is used, the number of previous turns need not be limited to one round (i.e., n player turns). The one round limitation is imposed to reduce the chance that players will abuse the back up feature.

To back up the score of a game, a player initiates activation of a reset mode or back up mode by pressing one or more buttons on the front panel 24 of the machine 10. In the disclosed embodiment of the invention, the reset mode is activated by simultaneously pressing the "Cancel game" button 52 and the "Player Change" button 54. These buttons exist on typical prior art electronic dart game machines, such as SCORPION DARTS manufactured by Merit Industries, Inc. However, heretofore, pressing such buttons simultaneously did not result in any action. The reset mode could also be activated by a separate, dedicated button (not shown), or by other means, if desired for a particular application.

Figure 3A:
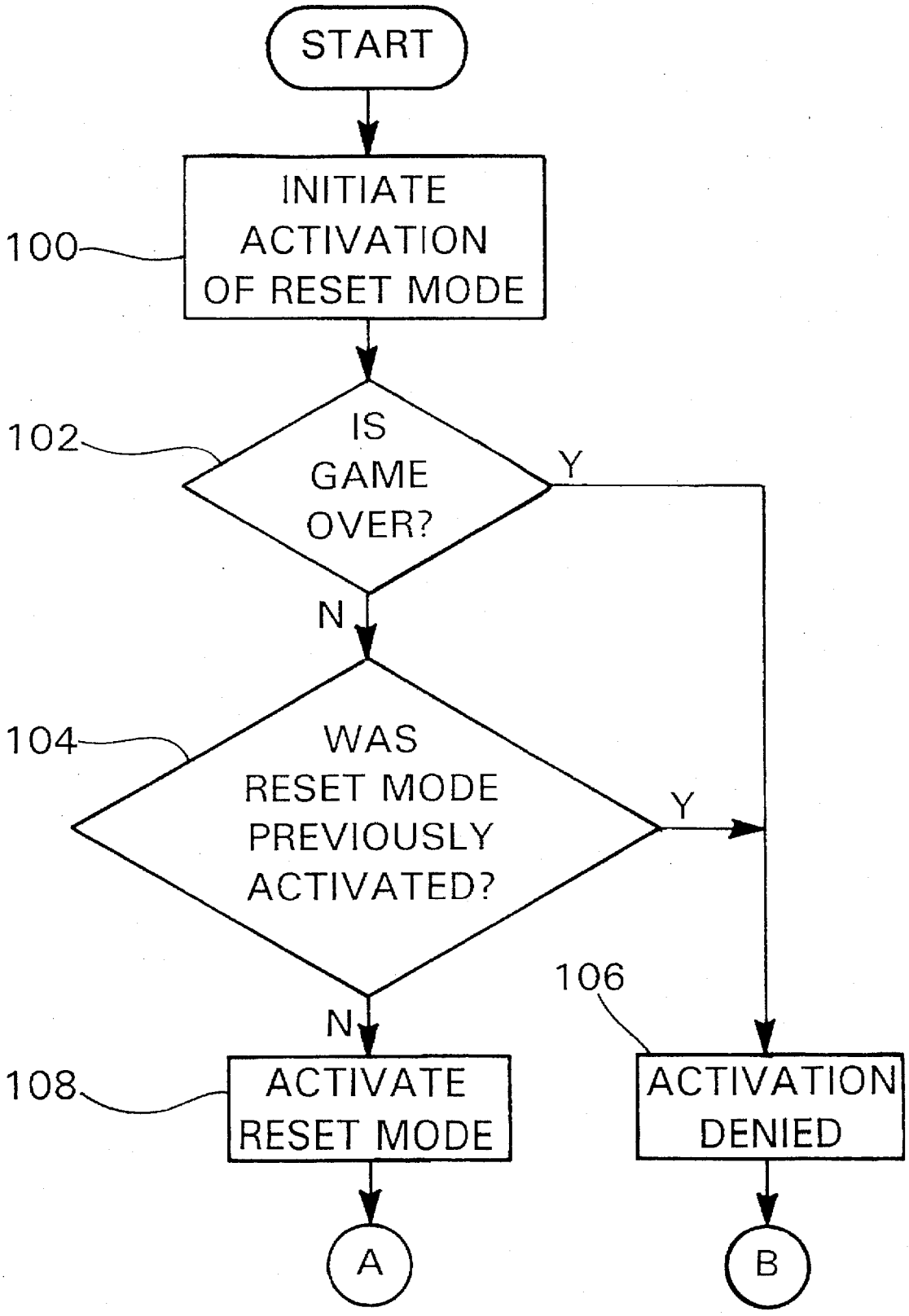
FIGS. 3A and 3B, taken together, are a flowchart of the operation of the score data memory circuitry and display circuitry of FIG. 1.
Figure 3B:
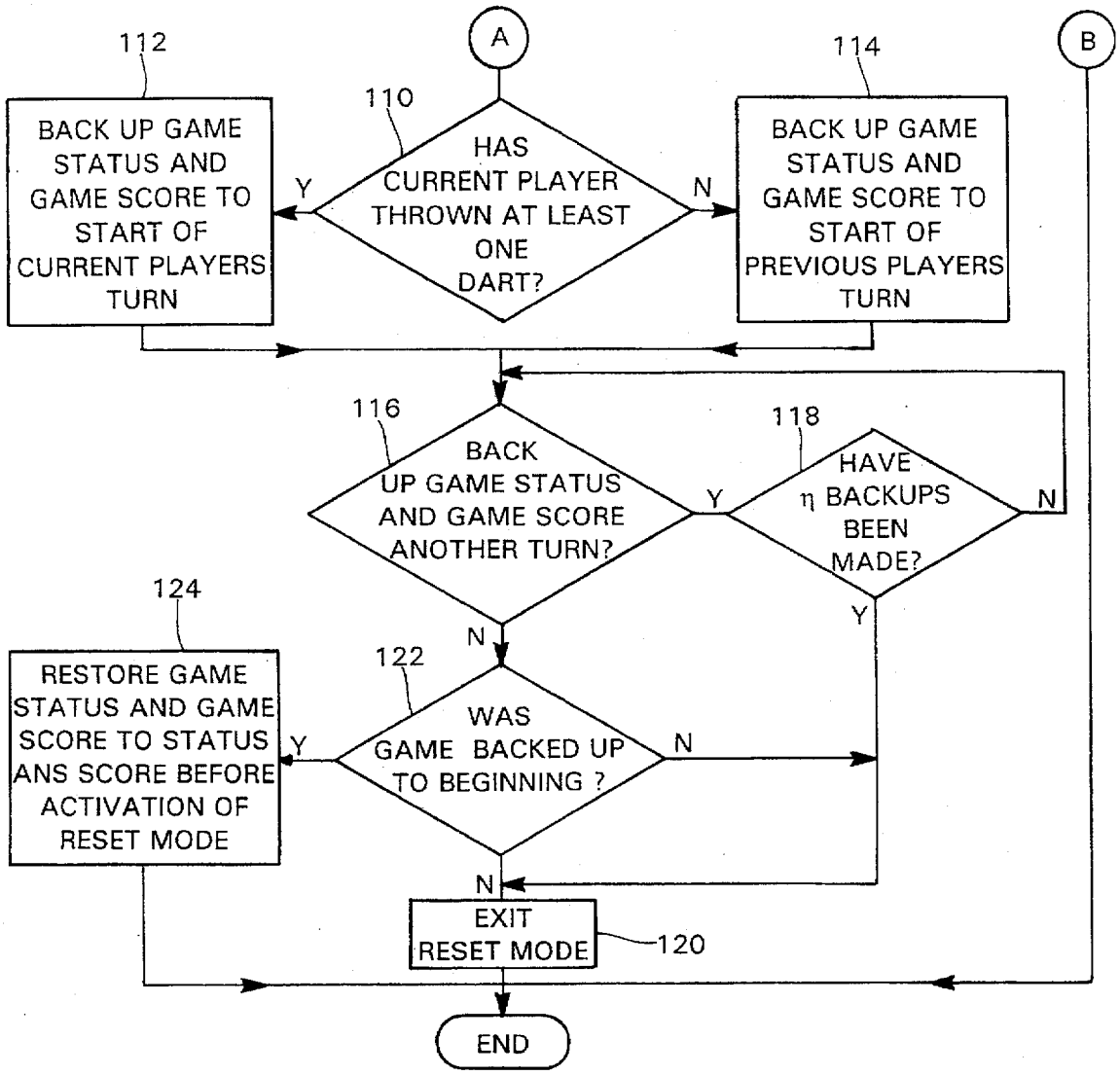

FIGS. 3A and 3B, taken together, are a flowchart of a preferred embodiment for implementing the present invention. The flowchart is described in steps 100–124. Some of the steps in the flowchart are player implemented steps, and some of the steps are performed in a program in the display computer 22. For convenience, elements in FIGS. 1 and 2 are referenced as needed in the description below. The process in FIGS. 3A and 3B may be initiated whenever an error is discovered in game play.

Referring to FIGS. 1, 2, 3A and 3B, a player initiates activation of a reset mode or back up mode by any of the means described above (step 100). If the current game has already been won by a player (i.e., if the game is over) (step 102), or if the reset mode has been previously activated in the same game (step 104), the reset mode cannot be activated (step 106). The display computer 22 includes a game over detector 56 and a reset mode detector 58 which are checked when performing the steps 102, 104, 106. The purpose of these steps is to prevent abuse of the reset feature and to avoid upsetting a player's expectations about the game status. By limiting the reset feature to one activation per game, the players are encouraged to try to reduce the occurrence of errors since they know that only one error can be corrected per game. Also, once a player has won a game, the late discovery of an error may be perceived as being unfair to the winner who may not have been the cause of the error. The steps 102 or 104 may be made optional, if desired. Alternatively, activation may be limited to a greater number of times per game, such as two or three.

If the game is not over, and the reset mode has not been previously activated in the same game, the reset mode is activated (step 108). If the current player has thrown at least one dart, and is thus in the middle of his turn, the game status and game score are backed up to the status and score present at the start of the current player's turn (steps 110, 112). If the current player has not yet begun his turn, the game status and game score are backed up to the status and score at the start of the previous player's turn (steps 110, 114). Next, if the error in game play occurred at an earlier point in time, the game status and game score are backed up again until the beginning of the turn in which the error occurred is reached (step 116 and iterative loop related thereto). As each back up occurs, the score data in display areas 26, 28, 30 and 32 are replaced or updated with appropriate previous score data stored in the memory locations 34–40 (FIG. 1 embodiment of score data memory 18), or memory locations 44–50 (FIG. 2 embodiment of score data memory 18'). Likewise, the game computer 16 is reset to the appropriate player so that new game scores are registered to the correct player. Each back up is activated in the same manner as the initial activation of the reset mode. Thus, there is one back up every time that the "Cancel game" button 52 and "Player Change" button 54 are simultaneously pressed.

To further prevent the players from abusing the reset mode and to avoid upsetting players' expectations about the game status, a limitation is imposed on the number of times the game score can be backed up upon activation of the reset mode. In the disclosed embodiment of the invention, the game can only be backed up to the "logical equivalent" of one round (i.e., one round, without regard to where a new round begins). If there are n players in a match, there are n player turns in a round. Thus, a game can be backed up no more than n times (step 118). After n back ups are made, the program exits the reset mode (step 120). A game can always be backed up to the "physical beginning" of each round, if for example, the error occurred at the beginning of the round. This is possible because the beginning of each round can always be reached without exceeding n back ups. Alternative embodiments of the invention may have a greater number of allowed back ups, such as 2n or 3n, and correspondingly larger score data memory locations to track previous scores. If a player abuse or upsetting of expectations are not a problem, there may also be no limitations on allowed back ups.

Once the players have reached the beginning of the turn in which the error occurred, the program checks to see if the game was backed up to the beginning (step 122). If so, the game status and game score are restored to the status and score prior to activation of the reset mode (step 124). This feature prevents players from abusing the reset mode by backing out of a game. Again, this feature may also be made optional. Of course, step 122 is only relevant at the beginning of the game because the limitation of n score back ups prevents players from backing up to the beginning of the game once round 2 has commenced. The program ends after the completion of steps 106, 120 or 124.

The present invention allows a dart game to be returned to a previous score state upon the detection of an error in game play. As discussed above, the error may be caused by a machine malfunction (i.e., electronic error) or by a player error (i.e., human error). The player error may be the result of the player shooting out of order, fouling, or being distracted by a sudden event in the game surroundings or other causes.

The present invention is not limited to being used only upon the occurrence of an error in the game. Instead, the score may be backed up upon the happening of any predesignated event. The event may require the game to be backed up by a predesignated number of turns (i.e., one or more turns). The event may occur randomly or be triggered by a predesignated condition.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. In a dart game machine including electronically stored game score data which is automatically updated based upon each player's turn throwing one or more darts, a method of returning the score data to a previous state, the method comprising:

(a) activating a reset mode upon the happening of an event in the game;

(b) backing up the game by one or more turns to the beginning of a player's turn; and (c) replacing current game score data with game score data in effect just before the turn in which the game is backed up to.

2. A dart game machine according to claim 1 wherein the method further comprising the step of:

(d) disabling the reset mode upon the existence of a predetermined condition.

3. A dart game machine according to claim 2 wherein the predetermined condition is that the dart game is completed.

4. A dart game machine according to claim 2 wherein the predetermined condition is that the reset mode was previously activated in the same dart game.

5. A dart game machine according to claim 1 wherein there are n players and the number of times that the game score can be backed up does not exceed n.

6. A dart game machine according to claim 1 wherein the event is a human error in game play, and the game score is backed up to just before the turn in which the human error occurred.

7. A dart game machine according to claim 1 wherein the event is an electronic error, and the game score is backed up to just before the turn in which the electronic error occurred.

8. A dart game machine according to claim 1 wherein there are n players and the method further comprises the step of:

(d) storing game score data for n previous player turns, wherein the number of times that a game can be backed up cannot exceed n.

9. An apparatus for returning a dart game to a previous state upon the happening of an event in the game, the apparatus including:

(a) a memory for electronically storing current game score data, and game score data for one or more previous player turns; and (b) a reset mode which, when activated, allows the game to be backed up to scores present at the beginning of previous turns, the current game score data being replaced with game score data that existed before the turn in which the game is backed up to.

10. An apparatus according to claim 9 further comprising:

(c) means for preventing activation of the reset mode upon the existence of a predetermined condition.

11. An apparatus according to claim 10 wherein the predetermined condition is that the dart game is completed.

12. An apparatus according to claim 10 further comprising:

(d) a reset mode detector, wherein the predetermined condition is that the reset mode was previously activated in the same dart game.

13. An apparatus according to claim 9 wherein there are n players and the number of times that the game score can be backed up cannot exceed n.

14. An apparatus according to claim 9 wherein the event is a human error in game play, and the game score is backed up to just prior to the turn in which the human error occurred.

15. An apparatus according to claim 9 wherein the event is an electronic error, and the game score is backed up to just prior to the turn in which the electronic error occurred.

16. An apparatus according to claim 9 wherein there are n players, the memory storing game score data for n previous player turns, and the number of times that a game score can be backed up cannot exceed n.

* * * * *